US005079477A

United States Patent [19]

Yamamoto

[11] Patent Number: 5,079,477

[45] Date of Patent: Jan. 7, 1992

[54] SLOT TYPE SHADOW MASK

[75] Inventor: Toshio Yamamoto, Shiga, Japan

[73] Assignee: Dainippon Screen Mfg. Co., Ltd., Japan

[21] Appl. No.: 427,096

[22] PCT Filed: Jan. 27, 1989

[86] PCT No.: PCT/JP89/00077

§ 371 Date: Oct. 2, 1989

§ 102(e) Date: Oct. 2, 1989

[87] PCT Pub. No.: WO89/07329

PCT Pub. Date: Aug. 10, 1989

[30] Foreign Application Priority Data

Feb. 2, 1988 [JP] Japan ..... 63-23615

[51] Int. Cl.[5] ..... H01J 29/81

[52] U.S. Cl. ..... 313/403; 313/402

[58] Field of Search ..... 313/402, 403; 445/66

[56] References Cited

U.S. PATENT DOCUMENTS

| | | | |
|---|---|---|---|
| 4,293,792 | 10/1981 | Roberts | 313/403 |
| 4,374,452 | 2/1983 | Koorneef | 445/66 |
| 4,734,615 | 3/1988 | Koike et al. | 313/402 |

FOREIGN PATENT DOCUMENTS

| | | | |
|---|---|---|---|
| 0074738 | 3/1983 | European Pat. Off. | 313/402 |
| 49131676 | 4/1973 | Japan . | |
| 49-79170 | 7/1974 | Japan . | |
| 55-2698 | 1/1980 | Japan . | |
| 2221085 | 1/1990 | United Kingdom | 313/402 |

*Primary Examiner*—Donald J. Yusko
*Assistant Examiner*—Diab Hamadi
*Attorney, Agent, or Firm*—Ostrolenk, Faber, Gerb & Soffen

[57] ABSTRACT

A slot type shadow mask for use in a color picture tube. The mask includes a mask plate member. The plate member is formed by a front plate and a rear plate which are joined to each other. Bridges of the front and rear plates divide slot holes within the rear and front plates, respectively.

4 Claims, 2 Drawing Sheets

SLOT TYPE SHADOW MASK

BACKGROUND OF THE INVENTION

1. Field of the Invention

The present invention relates to a slot type shadow mask for use in a shadow mask type color picture tube.

2. Description of the Background Art

As shown in FIG. 7, a shadow mask type color picture tube typically comprises three electron guns 1, a fluorescent screen 2 and a shadow mask 3. Electron beams B from the guns 1 cause the screen 2 to glow red, green and blue. The shadow mask 3 permits only certain of the electron beams B to pass through beam apertures 3A such that stripes of fluorescent material on the fluorescent screen 2 are caused to glow in response to image signals.

The mask 3 includes about a hundred thousand to hundreds of thousands of the strip-shaped beam apertures 3A. The apertures 3A have a horizontal dimension of 0.08 to 0.25 mm and a vertical dimension of 0.3 to 1.0 mm. The apertures 3A are defined within a steel plate which is 0.1 to 0.3 mm thick. The apertures 3A are arranged in a regular bricklaying manner. The apertures 3A are opened/formed by etching.

To form bright color images, it is necessary to increase the proportion of electron beams which are transmitted through the shadow mask 3. The width of each aperture is a function of (1) the arrangement of the different fluorescent materials on the screen 2 and (2) the transverse pitch between the beam apertures 3A. The bridges cannot be too thin and the length of each beam aperture cannot be too long or else the shadow mask will be broken during the molding, working and mounting of the shadow mask on the color picture tube.

The slot type shadow mask 13 shown in FIG. 8 has been proposed in U.S. Pat. No. 4,293,792. The mask 13 provides increased electron beam transmission.

The mask 13 has a large number of longitudinal beam apertures 13A which are vertically and transversely arrayed on a single mask plate member 14. Bridges **16*a* and 16*b* are alternately interposed between the beam apertures 13A. The bridges 16*a* are displaced toward a front surface $S_1$ and the bridges 16*b* are displaced toward a rear surface $S_2$. The mask plate member 14 has a thickness T. The thickness of the bridges 16*a*, 16*b*** is less than T.

The shadow mask 13 is fabricated by applying photoresist films to front and rear surfaces of a thin metal plate, drying the same, contact-printing shadow mask patterns on the front and rear surfaces, spray etching and then separating the photoresist films.

To displace the bridges **16*a* toward the surfaces $S_1$ and to displace the bridges 16*b* toward the rear surfaces $S_2$, it is necessary to etch the single mask plate member 14 from the front and rear surfaces. To do this, the etching speed, the pressure of the etching solution and the like must be strictly controlled. This means that the dimensions of the beam apertures 13A as well as the dimensions of the bridges 16*a* and 16*b* are simultaneously controlled during etching on the premise that the thickness of the thin metal plate, the thickness of the photoresist films, the sensitivity of the photoresist material and the like are not variable. However, it is necessary to perform etching while most emphasizing the opening dimensions of the beam apertures 13A in practice. Hence, if the thickness of the materials is variable, the thicknesses of the bridges 16*a* and 16*b* are correspondingly variable If the bridges are too thin, strength is reduced and the bridges may be broken during molding/working. In sum, it is difficult to fabricate the mask 13** by etching.

Further, the positions of the beam apertures and the stripes of fluorescent materials must correctly coincide with each other.

However, since the shadow mask forms an anode of the color picture tube with the fluorescent materials, the percentage of electron beam transmission through the shadow mask is only about 20%. Power loss at the anode reaches 80%. When anode power is about 25 watts (W) in a 20-inch color picture tube, 20 W of power is expended by the shadow mask. This causes the temperature of the shadow mask to increase by about 40° C. The mask expands by about 100 μm as a result. Such thermal expansion prevents coincidence of the electron beams and the fluorescent materials. The picture tube's color purity is therefore reduced.

In this regard, generally known is a shadow mask which is formed by two plate members so that corresponding slot holes of the second plate member are brought into close contact with slot holes of the first plate member or opposed to the same with small clearances thereby to increase the strength of the shadow mask, as disclosed in Japanese Patent Laid-Open No. 79170/1974. Japanese Patent Laid-Open No. 131676/1974 discloses preventing local thermal expansion by stacking two sliced shadow masks (plate members) so that a large number of openings entirely overlap each other. However, the percentage of electron beam transmission in these masks is changed by displacement of the positions of the slot holes (openings) of the overlapped plate members due to thermal expansion of master patterns (which are employed for printing shadow mask patterns), distortion caused during etching of the shadow mask, inaccurate alignment of the plate members and the like.

Further, transmission irregularity caused by inaccurate hole configurations within a plate member is compounded when such plate members are overlapped.

U.S. Pat. No. 4,374,452 discloses a post-focusing type color picture tube with means for improving the brightness of displayed images by increasing the percentage of electron beam transmission in a color selector.

SUMMARY OF THE INVENTION

The present invention overcomes the above-described problems. An object of the invention is to provide a slot type shadow mask which can be easily manufactured, which has excellent strength and which transmits a high percentage of electron beams with a small amount of transmission irregularity.

The present invention relates to a shadow mask with beam apertures for controlling electron beam transmission within a color picture tube. The shadow mask includes: a front plate having a large number of slots and bridges; and a rear plate having a large number of slots and bridges. The rear plate is joined to the front plate. The front plate and the rear plate are arranged with respect to each other such that the bridges of the front plate and the rear plate divide the slots of the rear plate and the front plate, respectively, into the beam apertures.

According to the present invention, the front plate and the rear plate are separately etched to define the longitudinal slot holes. During such etching, bridges of prescribed dimensions are formed by controlling only the dimensions of the slot holes. The bridges are as thick as the respective plate. Thus, strength is improved such that the shadow mask is not broken during molding-/working.

By reducing the thickness of the bridges, the percentage of electron beam transmission is improved, particularly in peripheral edge portions of the shadow mask.

Further, the present invention eliminates deviation in the percentage of electron beam transmission through the mask caused by overlapping the front and rear plates. In the present invention, transmission irregularity is substantially determined by the plate member with the smaller openings. The beam apertures of the slot type shadow mask are in the form of strips. Hence the areas of light transmitting portions are largely influenced by the opening width of the beam apertures, i.e., the smaller opening width. Influence caused by deviation in bridge width is small.

Preferably, the thickness of the plate members is a function of the opening width of the slot holes. Preferably, the plate member with the smaller openings is thinner than the other plate member. The holes through the thinner plate member can be etched more accurately.

DETAILED DESCRIPTION OF THE PREFERRED EMBODIMENTS

Figure 1:
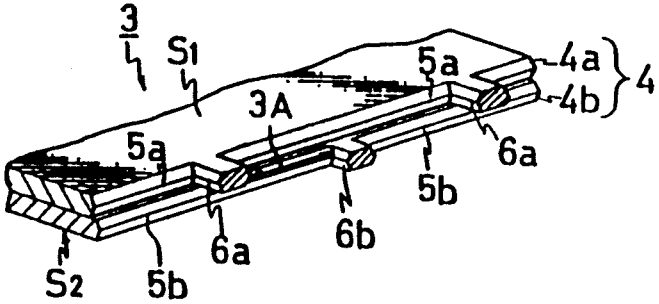
FIG. 1 is an enlarged perspective view showing an essential part of a slot type shadow mask according to the present invention.

Referring to FIG. 1, a slot type shadow mask 3 includes a front plate 4*a* and a rear plate 4*b* which are joined to each other to form a mask plate member 4. Longitudinal slot holes 5*a* and 5*b* are vertically and transversely arrayed/formed in the front plate 4*a* and the rear plate 4*b* by etching from both sides.

The slot holes 5*a* and 5*b* are vertically displaced by half a pitch from each other so that bridges 6*a* and 6*b* mutually uniformly divide the slot holes 5*b* and 5*a* when the plates 4*a* and 4*b* are joined to each other. Beam apertures 3A are defined by the slot holes 5*a*, 5*b* and the bridges 6*a*, 6*b*.

The plates 4*a*, 4*b* can be formed of thin plates of aluminum killed steel or Invar alloy having a nickel content of 36%. The plates 4*a*, 4*b* are joined to each other by spot welding the peripheral edge portions (the skirt portions) of the shadow mask. Alternately, the plates 4*a*, 4*b* can be adhered together by polyimide resin.

Figure 3:
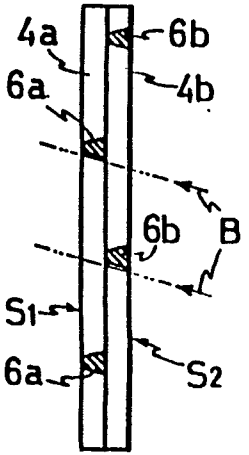
FIG. 3 is a sectional view along the line III—III in FIG. 2.
Figure 2:
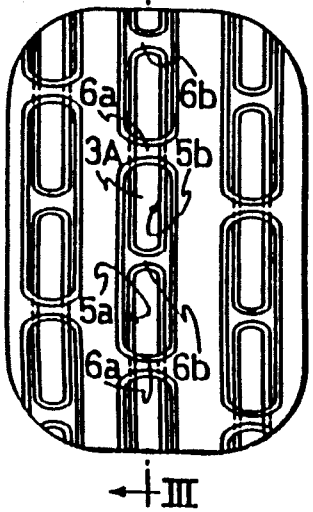
FIG. 2 is an enlarged front view showing an essential part of a slot type shadow mask according to another embodiment of the present invention.

Strip-shaped slot holes 5*a* and 5*b* illustrated in FIGS. 2 and 3 are formed by etching both of the plates 4*a*, 4*b* from a front surface side $S_1$. The holes 5*a*, 5*b* have a transverse dimension of about 0.2 mm and a vertical dimension of about 1.2 mm. The holes 5*a*, 5*b* are regularly arranged vertically and transversely in the plates 4*a* and 4*b*. The mask is formed by etching each of the plates 4*a*, 4*b* from a front surface side $S_1$, each one of the slot holes being conically opened/formed. When the plates 4*a*, 4*b* are joined to each other, the bridges 6*a*, 6*b* uniformly divide the slot holes 5*b*, 5*a* to define the beam apertures 3A, as in the embodiment shown in FIG. 1. Thus, the bridges 6*a* are displaced toward the front surface $S_1$ side of the shadow mask and the bridges 6*b* are displaced toward a rear surface $S_2$ side.

The bridges 6*a*, 6*b* are reduced in thickness as compared with the overall mask plate member such that the percentage of transmission of electron beams B is improved.

Figure 7:
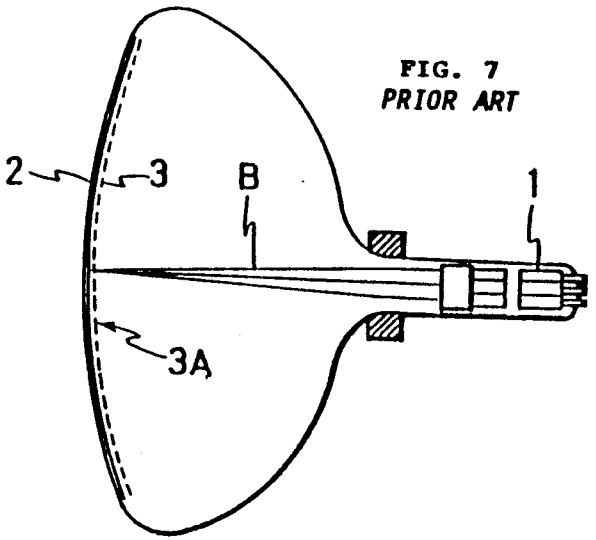
FIG. 7 PRIOR ART
FIG. 7 is a schematic diagram of a color picture tube.
Figure 8:
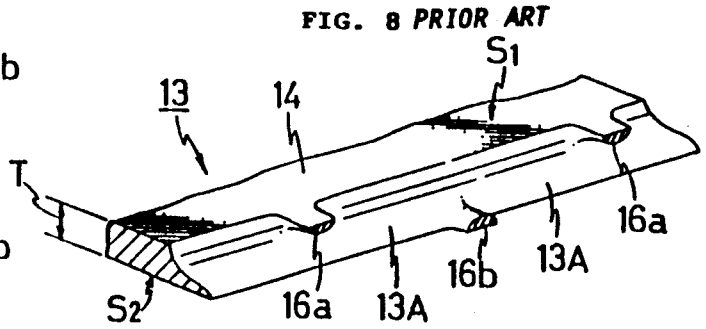
FIG. 8 PRIOR ART
FIG. 8 is an enlarged perspective view showing an essential part of a conventional slot type shadow mask.
Figure 4:
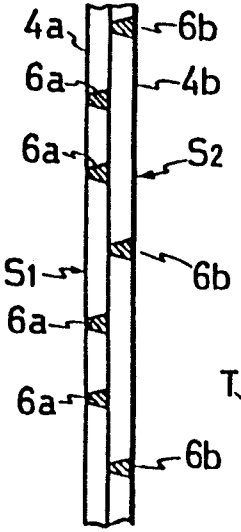
FIG. 4 is an enlarged sectional view of still another embodiment.

In the mask illustrated in FIG. 4, bridges 6*a* and 6*b* are not alternately displaced toward a front surface side $S_1$ and a rear surface side $S_2$. Instead, there are two of the bridges 6*a* for every one of the bridges 6*b*. The bridges 6*a* and 6*b* are periodically displaced on the front surface side $S_1$ and the rear surface side $S_2$ of the shadow mask.

The ratio of displacement of the bridges 6*a* and 6*b* is not restricted to 2:1. An integer-to-integer ratio such as 3:2 or 4:5 may be employed. Further, periodic displacement is not necessarily required.

Figure 5A:
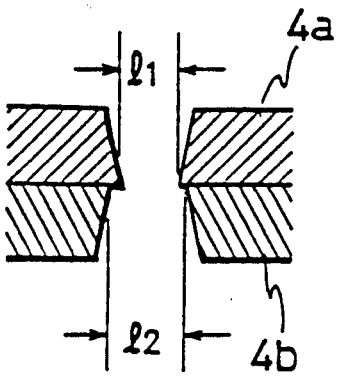
FIGS. 5*a* to 5*c* and 6*a* to 6*d* are sectional views of slot holes of further embodiments.

FIG. 5*a* shows an example in which the slot hole opening width $l_1$ of a front plate 4*a* is smaller than the slot hole opening width $l_2$ of a rear plate 4*b*. Thus, for example, assuming that $l_1$ is 200 m and $l_2$ is 240 $\mu$m, the slot holes have a difference of 20 $\mu$m on either side. In this case, the percentage of electron beam transmission is influenced only by the slot holes of the front plate 4*a*.

Figure 5B:
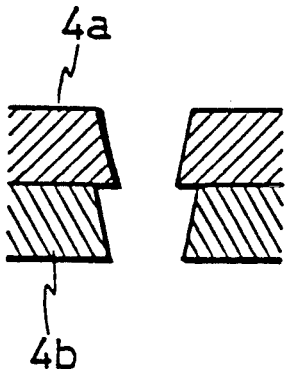

FIG. 5*b* shows an example in which a rear plate 4*b* is inverted from the state illustrated in FIG. 5*a*. Again, the percentage of electron beam transmission is influenced only by the slot holes of the front plate 4*a*.

Figure 5C:
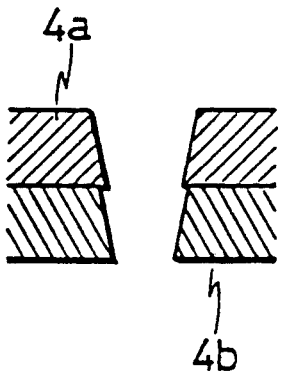
Figure 6A:
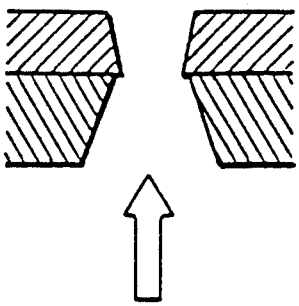
Figure 6B:
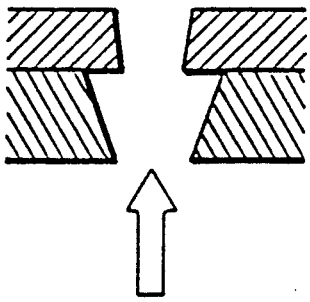
Figure 6C:
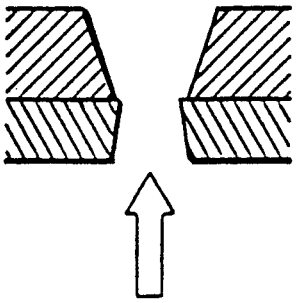
Figure 6D:
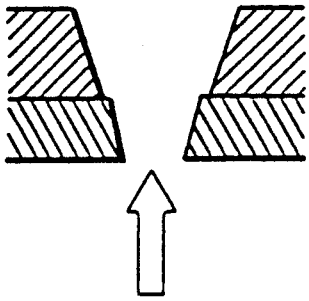

FIG. 5*c* shows an example in which the slot hole opening width of a rear plate 4*b* is smaller than the slot hole opening width of a front plate 4*a*. In this case, the percentage of electron beam transmission is influenced by the slot holes of the rear plate 4*b*.

The difference in width on each side of the slot holes is generally 5 to 50 $\mu$m. The difference is variable because the array pitch of the slot holes and the slot hole opening width vary with the resolution required for the shadow mask.

A superior shadow mask (from a practical standpoint) can be obtained by making the opening width of slot holes on one side of the mask smaller than the opening width of slot holes provided on the other side of the mask. Unlike the prior art, the percentage of electron beam transmission is not adversely influenced by distortion of the larger slot holes.

In FIGS. 6*a* to 6*d*, the plate members have different slot hole opening widths. The thicknesses of the plate members are also taken into consideration to further reduce influence on the percentage of electron beam transmission. In particular, adverse influence on electron beam transmission can be reduced by the thickness of the plate member having the smaller slot opening width.

In general, slot holes can be more accurately etched through the thin plate member. Since transmission irregularities are caused by incorrect hole configuration, such irregularities are reduced when a thin plate member is provided with thin slot hole openings. Transmission irregularities caused by the thick plate member do not exert an adverse influence.

A shadow mask formed by joining plate members with thicknesses of 0.2 mm and 0.3 mm was found to cause less transmission irregularity than a shadow mask formed by joining two plate members each of which was 0.25 mm thick.

The embodiments shown in FIGS. 5*a* to 5*c* and 6*a* to 6*d* are illustrated on the assumption that electron beams are transmitted upwardly.

It is understood that the bridges of one plate need not equally divide the slot holes of the other plate. Further, alternative joining methods for joining the plates may be used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shadow mask with beam apertures for controlling electron beam transmission within a color picture tube, the shadow mask comprising:

a front plate having a large number of slots and bridges; and a rear plate having a large number of slots and bridges, the rear plate being joined to the front plate;

wherein the front plate and the rear plate are arranged with respect to each other such that the bridges of the front plate and the rear plate divide the slots of the rear plate and the front plate, respectively, into the beam apertures.

2. The shadow mask of claim 1, wherein the front plate has a rear surface, and the rear plate has a front surface which is in contact with the rear surface of the front plate, such that there is essentially no space between the front and rear plates.

3. The shadow mask of claim 1, wherein the slots of the front and rear plates are elongated in a vertical direction and are arranged within vertical columns, the bridges extending in a horizontal direction.

4. The shadow mask of claim 3, wherein the slots of one of the plates are wider in the horizontal direction than the slots of the other plate, and wherein the other plate is thinner than the one plate.

* * * * *